US007442919B2

(12) United States Patent
Ishiuchi

(10) Patent No.: US 7,442,919 B2
(45) Date of Patent: Oct. 28, 2008

(54) SUPERCRITICAL FLUID JET METHOD AND SUPERCRITICAL FLUID JET MASS ANALYSIS METHOD AND DEVICE

(75) Inventor: Shun-ichi Ishiuchi, Kanagawa (JP)

(73) Assignee: Japan Science and Technology Agency, Saitama (JP)

( * ) Notice: Subject to any disclaimer, the term of this patent is extended or adjusted under 35 U.S.C. 154(b) by 269 days.

(21) Appl. No.: 10/598,248

(22) PCT Filed: Feb. 25, 2005

(86) PCT No.: PCT/JP2005/003157

§ 371 (c)(1),
(2), (4) Date: Aug. 22, 2006

(87) PCT Pub. No.: WO2005/083417

PCT Pub. Date: Sep. 9, 2005

(65) Prior Publication Data

US 2007/0164206 A1 Jul. 19, 2007

(30) Foreign Application Priority Data

Feb. 27, 2004 (JP) ..... 2004-053391

(51) Int. Cl.
*H01J 49/00* (2006.01)
*H01J 49/04* (2006.01)
*B01D 59/44* (2006.01)

(52) U.S. Cl. ..... 250/251; 250/251; 250/282; 250/288

(58) Field of Classification Search ..... 250/251, 250/282, 281, 288
See application file for complete search history.

(56) References Cited

U.S. PATENT DOCUMENTS 4,902,891 A * 2/1990 Vestal ..... 250/281

(Continued)

FOREIGN PATENT DOCUMENTS

JP 5-333016 12/1993
JP 2003-329556 11/2003

OTHER PUBLICATIONS

Pang et al., "Supercritical fluid jet expansions of polar aromatic carboxylic acids using simple derivatization with detection by resonant two-photon ionization," Spectrochimica Acta, vol. 43B, Nos. 4/5, pp. 671-677, 1988.

(Continued)

*Primary Examiner*—Nikita Wells
(74) *Attorney, Agent, or Firm*—Greenblum & Bernstein, P.L.C.

(57) ABSTRACT

A supercritical fluid jet generating device (1) wherein a pulse valve (5) is used to supersonic-jet a mixture of a supercritical fluid and a non-volatile sample or a mixture of a supercritical fluid and a pyrolytic sample and obtain a supersonic jet expansion, the supersonic jet expansion is introduced via a skimmer (8) into a differential evacuation chamber (10) under a high vacuum of at least $10^{-5}$ Torr, the jet expansion is passed through a skimmer (12) to obtain a molecular beam (M) under a high vacuum of at least $10^{-7}$ Torr, an intermolecular-collision-free sample molecule in the lowest energy level or the molecule aggregate ion of the sample molecule is obtained from the molecular beam (M) in a laser ionization chamber (13) by means of a resonance multi-photon ionizing method by a wavelength variable laser (L), and the ion is mass-analyzed. Thus, the lowest energy level data on a non-volatile or pyrolytic molecule or the molecule aggregate of that molecule and a thermally-unstable molecule or the molecule aggregate of that molecule or the like is obtained.

6 Claims, 5 Drawing Sheets

U.S. PATENT DOCUMENTS

| | | | | |
|---|---|---|---|---|
| 5,070,240 | A * | 12/1991 | Lee et al. | 250/288 |
| 7,038,217 | B2 * | 5/2006 | Yamada et al. | 250/424 |
| 7,247,495 | B2 * | 7/2007 | Amirav | 436/173 |
| 2003/0168592 | A1 | 9/2003 | Yamada et al. | |

OTHER PUBLICATIONS

Sakamoto et al., "Development of Supercritical Fluid Extractor Coupled with a Time-of-Flight Mass Spectrometer for Online Detection of Extracts," Analytical Sciences, vol. 19, pp. 853-857, Jun. 2003.

English Language Abstract of JP 2003-329556.

Ishiuchi et al., "Four-color hole burning spectra of phenol/ammonia 1:3 and 1:4 clusters," Journal of Chemical Physics, vol. 120, No. 7, Feb. 15, 2004.

English Language Abstract of JP 5-333016.

* cited by examiner

SUPERCRITICAL FLUID JET METHOD AND SUPERCRITICAL FLUID JET MASS ANALYSIS METHOD AND DEVICE

TECHNICAL FIELD

This invention relates to a method of using a supersonic jet technique to put a mixture of a non-volatile sample dissolved in a supercritical fluid or a mixture of a pyrolytic sample dissolved in a supercritical fluid into a gaseous state of an ultra cold and isolated state and thereby obtaining, in vacuum, sample molecules in the lowest energy level without intermolecular collisions or molecular aggregates containing these sample molecules, and an analysis technique of selectively ionizing the sample molecules or the molecular aggregates containing the sample molecules in the abovementioned supersonic jet expansion by a resonance-enhanced multiphase laser ionization technique and performing mass spectrometry on the sample molecules in the lowest energy level without intermolecular collisions or the molecular aggregates containing these sample molecules.

BACKGROUND ART

Mass spectrometry has become an essential art in such fields as microanalysis of environmental pollutants, structure determination of proteins and other bimolecular or molecular aggregates, etc. There are three problems in mass spectrometry: 1) introduction (interfacing) into vacuum and vaporization/ionization of a sample; 2) attainment of high mass resolution; and 3) attainment of high sensitivity; and various methods have been proposed for the respective problems.

For applying mass spectrometry to various samples, development of new arts concerning 1) above is essential. Though gaseous samples, volatile samples, and samples that are readily vaporized by heating can be introduced into vacuum after vaporization and ionized using a laser, electron gun, etc., vaporization and ionization without fragmentation of the sample is a major issue for non-volatile samples and pyrolytic samples. Presently, the following two types of methods are mainly put to practical use as methods for vaporizing non-volatile samples and pyrolytic samples.

Firstly, there are methods of performing instantaneous heating and vaporization using a laser (laser desorption method). These methods were originally developed to vaporize metals. When a laser is focused onto a sample, the sample is heated to several thousand degrees Celsius instantaneously and is thereby vaporized. However, when a laser method is applied likewise to an organic molecule, dissociation of the molecule occurs due to multiphase absorption and large amounts of fragments are generated, making analysis of a mass spectrum difficult.

As a method of resolving this problem, a sample can be imbedded in a matrix and laser light whose wavelength is fixed to an absorption band of the matrix can be used to prevent the dissociation of the sample. This method is called the matrix-assisted laser desorption ionization (MALDI) method.

In the other type of method, a solution of a sample is prepared and the sample is vaporized by removing the solvent. In the case of electrolytic samples, a method is used in which an electro spray is used to take ions out from the solution and introduce the ions into vacuum via an orifice (electro spray ionization (ESI) method).

There is also the thermo spray (TS) method, in which a sample solution is introduced and vaporized in a capillary, heated by a heater, and then sprayed into vacuum.

With these methods, a key to technical development lies in how the solvent is removed, and as methods of using a solvent that is more readily removed, there are methods of using supercritical fluids (liquefied gases) (supercritical fluid mass spectrometry (SCF-Mass)) In such a method, when a supercritical fluid solution of a sample is introduced into vacuum via an ultrafine capillary, the solvent and the sample vaporize immediately.

A method of performing mass spectrometry of molecules using a supercritical fluid (liquefied gas) of carbon dioxide, etc., is disclosed in Non-Patent Document 1 mentioned below, etc.

In the abovementioned MALDI method and ESI method, which are know as methods of ionizing a vaporized sample, vaporization and ionization of the sample are carried out simultaneously. With a general mass analyzer, which is used upon connection to a gas (liquid) chromatograph, or with the TS method or the SCF-Mass method, etc., a gaseous sample must be ionized by some method.

A most generally used method is the electron impact ionization method, in which a discharge or an electron gun is used. Though this method is inexpensive and enables easy maintenance in terms of device, because the excess energy that is applied to molecules in the ionization process is extremely large, it is difficult to avoid dissociation (decomposition) of sample molecule. A large number of fragment peaks thus appear in a mass spectrum and extremely troublesome analysis is required.

On the other hand, with the laser ionization method, excess energy in the ionization process can be restrained readily and thus the dissociation of sample molecules can be lowered by adjustment of the laser wavelength. This method is thus referred at times as the soft/intact ionization method.

However, the mass spectrometry method gives information of only molecular masses, thus isomers of sample molecules or molecular aggregates obviously cannot be distinguished, and detailed information on molecular structures of sample molecules or molecular aggregates cannot be obtained from just the molecular mass data. However, by using the laser ionization method, in which vaporized sample molecules or molecular aggregates are ionized by a laser, various laser spectroscopic techniques can be applied to the vaporized sample to enable extremely detailed information to be obtained on the molecular structures of sample molecules or molecular aggregates as well as enable separation and observation of isomers of sample molecules or molecular aggregates using differences in electronic transition energy.

However, if the sample molecules or molecular aggregates are thermally distributed among various vibration states, an extremely complex electronic spectrum is obtained because various electronic transitions from different initial states are observed simultaneously, and not only analysis of the spectrum becomes difficult but the molecular selectivity is lowered as well. To resolve this problem, the sample molecules may be cooled and put in the lowest energy level. This is enabled by a supersonic jet technique. When a mixed gas of a sample gas and a carrier gas, such as a noble gas, is adiabatically expanded in vacuum via an orifice, a supersonic jet containing the vaporized sample molecules is generated.

It is known conventionally, from research by the present inventors described in Non-Patent Document 2 mentioned below, that by jetting a mixed gas, obtained by mixing helium gas or other carrier gas with a "volatile substance (the volatility is determined by the vapor pressure unique to a sample)" that can form a mixed gas, into vacuum from an orifice, vaporized sample molecules in an ultra cold state (the lowest energy level) without intermolecular collisions can be obtained to enable recognition of internal energy levels of the sample molecules.

Also in Japanese Published Unexamined Patent Application No. 2003-329556 (Patent Document 1) is disclosed a molecular beam generating method and device, with which a neutral molecular beam of a wide range of types of molecules, in particular, molecules that decompose upon high temperature heating or molecules that do not volatilize even when heated to a high temperature can be generated, and the molecules and molecular aggregates contained in the generated neutral molecular beam can be ionized to enable mass spectrometry, spectroscopic measurement, etc.

Non-Patent Document 1. T. Sakamoto, A. Yamamoto, M. Owari, and Y. Nihei, "Development of a Supercritical Fluid Extractor Coupled with a Time-of-Flight Mass Spectrometer for Online Detection of Extracts," Analytical Sci. 19, 853 (2003).

Non-Patent Document 2. S. Ishiuchi, K. Daigoku, K. Hashimoto, and M. Fujii, "Four-color hole burning spectra of phenol/ammonia 1.3 and 1:4 clusters," J. Chem. Phys. 120, 3215 (2003).

Patent Document 1. Japanese Published Unexamined Patent Application No. 2003-329556

DISCLOSURE OF THE INVENTION

Problem to be Solved by the Invention

A sample, with which molecules are put in the lowest energy level by the above-described supersonic jet technique, can be obtained only with a readily-vaporized "volatile substance" that can form a mixed gas with a carrier gas, such as helium gas, and with a non-volatile or pyrolytic substance, such as a polymer, because vaporization cannot be achieved unless heating is performed, sample molecules or molecular aggregates in an isolated, ultra cold state without intermolecular collisions could not be obtained.

With the abovementioned SCF-Mass method, a non-volatile sample, pyrolytic sample or thermally unstable sample, etc., can be subject, regardless of the sample being of electrolytic or non-electrolytic molecules, to mass spectrometry by using a supercritical fluid (liquefied gas) of carbon dioxide, etc., and without heating to a "high temperature." However, with the conventional SCF-Mass method, only information on thermally excited sample molecules or molecular aggregates can be obtained, and because only masses need to be measured for mass spectrometry, there was no need to obtain a sample in which the molecules or molecular aggregates are in the lowest energy level.

The invention of Patent Document 1 (Japanese Published Unexamined Patent Application No. 2003-329556) provides, as shall be described in detail later, a method in which a solution sample is delivered by an atomizing introducing means into an atomizing chamber via a small aperture, solute molecules stripped of solvent molecules are generated by making the delivered mist-form solution of the sample collide with a gas or heating the mist-form solution, and then the solute molecules are delivered via a small aperture into a low pressure space to thereby atomize the sample from the small aperture into the low pressure space and generate a beam of sample molecules.

With the invention disclosed in Japanese Published Unexamined Patent Application No. 2003-329556, vaporization of a non-volatile sample is performed by a first delivery means 54 and jet cooling is performed by a second delivery means 54 as shown in FIG. 6. When the vaporization of the non-volatile sample and jet cooling are performed in two stages as in this method, the sample may cool and solidify before the jet cooling. If in order to prevent this, a continuous introducing method (a method of continuously introducing the sample into vacuum not by a pulse valve but by a pinhole), in which the flow rate of second delivery means 54 is made high and the non-volatile sample is introduced into a vacuum device 56 before the sample cools and precipitates as a solid, is to be employed, a high degree of vacuum cannot be maintained unless a pump of exceptionally high evacuation rate is employed, and thus, an adequate jet cooling effect cannot be obtained with a normal vacuum device.

Thus, an object of this invention is to establish an spectrometry method and device that use a supercritical fluid to obtain sample molecules in the lowest energy level of non-volatile or pyrolytic sample molecules or molecular aggregates containing these sample molecules, or of thermally unstable sample molecules or molecular aggregates containing these sample molecules.

Another object of this invention is to establish a method and device that use a supercritical fluid to obtain an ionized sample of non-volatile or pyrolytic molecules or of molecular aggregates containing these molecules, or of thermally unstable molecules or of molecular aggregates containing these molecules, for obtaining detailed information on internal energy levels of the ionized molecules or molecular aggregates or on structures of the molecules or molecular aggregates.

MEANS FOR SOLVING THE PROBLEM

The above objects of this invention are attained by the following means.

The invention of a first claim provides a method in which a mixture of a supercritical fluid and a non-volatile sample or a mixture of a supercritical fluid and a pyrolytic sample is jetted into a high vacuum chamber of $10^{-7}$ Torr or more to generate a supersonic jet expansion of sample molecules in the lowest energy level without intermolecular collisions or molecular aggregates containing these sample molecules.

The abovementioned sample is a non-volatile or pyrolytic sample, a thermally unstable sample, etc., that may be either an electrolytic substance or a non-electrolytic substance.

Molecular aggregates of the sample molecules are formed in the process of jetting the sample molecules.

This supercritical fluid jet can be applied not only to a method, to be described below, of performing laser ionization mass spectrometry of the lowest energy level of the sample molecules or molecular aggregates of the non-volatile or pyrolytic sample mixed with the supercritical fluid, but can also be applied as a method of non-destructively vaporizing the non-volatile or pyrolytic sample in manufacturing a structural multilayer film by molecular beam epitaxial of the non-volatile or pyrolytic molecules, flattening a solid surface by sputtering (making flexible molecules collide to obtain a flatter surface than that which can be obtained making atoms collide), etc.

The invention of a second claim provides a mass spectrometry method using the supercritical fluid jet method, in which a mixture of a supercritical fluid and a non-volatile sample or a mixture of a supercritical fluid and a pyrolytic sample is put under high vacuum of $10^{-7}$ Torr or more to generate a supersonic jet expansion of sample molecules in the lowest energy level without intermolecular collisions or molecular aggregates containing these sample molecules to obtain a molecular beam, ions of the abovementioned sample molecules in the lowest energy level without intermolecular collisions or molecular aggregates containing these sample molecules are obtained from the molecular beam by a laser ionization method, and mass spectrometry is performed on the ions.

The invention of a third claim provides the mass spectrometry method using the supercritical fluid jet method according to the second claim, in which, in a supercritical jet generating device, a pulse valve is used to perform supersonic jetting of a mixture of a supercritical fluid and a non-volatile sample or a mixture of a supercritical fluid and a pyrolytic sample to obtain a supersonic jet expansion, the supersonic jet expansion is introduced via a skimmer into a differential evacuation chamber under high vacuum of $10^{-5}$ Torr or more, the abovementioned supersonic jet expansion is furthermore passed, via a skimmer, through high vacuum of $10^{-7}$ Torr or more to obtain a molecular beam, sample molecules in the lowest energy level without intermolecular collisions obtained from the abovementioned molecular beam or molecular aggregates containing these sample molecules are ionized by a resonance-enhanced multiphase ionization method using a tunable laser, and mass spectrometry is performed on the abovementioned ions.

The invention of a fourth claim provides the mass spectrometry method using the supercritical fluid jet method according to the third claim, in which 25 volume % or less of at least one modifier selected from the group of modifiers consisting of water, methanol, ethanol, dioxin, acetonitrile, tetrahydrofuran, isopropyl ether, and diethyl ether is added to the mixture of the abovementioned supercritical fluid and the abovementioned sample.

The invention of a fifth claim provides amass spectrometry device using a supercritical fluid jet method comprising: a supercritical fluid jet generating device that performs supersonic jetting of a mixture of a supercritical fluid and a non-volatile sample or a mixture of a supercritical fluid and a pyrolytic sample; a laser ionization chamber that obtains and ionizes a molecular beam from a supersonic jet expansion jetted from the jet generating device; and a mass analyzer, performing mass spectrometry of ions obtained from the laser ionization chamber.

The invention of a sixth claim provides the mass spectrometry device using the supercritical fluid jet method according to the fifth claim, in which a pulse valve that generates the supersonic jet expansion is disposed in the abovementioned supercritical fluid jet generating device, a differential evacuation chamber is disposed between the abovementioned jet generating device and the laser ionization chamber, and skimmers are disposed at respective portions through which the abovementioned supersonic jet expansion passes between the abovementioned jet generating device and the abovementioned differential evacuation chamber and between the abovementioned differential evacuation chamber and the abovementioned laser ionization chamber.

The supercritical fluid used in the present invention is carbon dioxide, dinitrogen oxide (nitrous oxide), Fluor hydrocarbon, etc.

In this invention, a "supercritical fluid" of carbon dioxide, etc., is used instead of "helium gas" as a fluid (hereinafter, "carrier") for dissolving a sample for the following reasons.

Because helium is a gas, it does not have a function of "dissolving" the sample, and in a case where helium is used, the sample vaporizes according to the vapor pressure unique to the sample and becomes a mixed gas with helium. In a case where helium gas or other normal gas is used as a carrier, regardless of the type of carrier, the amount of sample "dissolved" is determined just by the saturation vapor pressure unique to the respective sample molecules. Thus, molecules or molecular aggregates of naphthol or other non-volatile sample do not vaporize in helium unless heated.

That is, in a case of a "readily vaporized sample" that can form a mixed gas with a gas carrier, the corresponding sample molecules or molecular aggregates in the lowest energy level can be obtained by the jet cooling method. However, with a gas carrier, a non-volatile substance cannot be vaporized unless it is heated. If the sample is a pyrolytic substance, because the sample dissociates (decomposes) upon heating, the jet cooling method using a gas carrier cannot be applied to such a sample.

On the other hand, a supercritical fluid of carbon dioxide gas, etc., has properties of a liquid with an ability of a solvent that "dissolves" sample molecules or molecular aggregates, and differs from helium and other simple gases in this point. With a supercritical fluid, the amount "dissolved" varies according to the type and pressure of the fluid and also varies with the addition of a minute amount of an abovementioned additive (modifier). Such properties are not possible with helium and other gases.

A major characteristic of this invention is that it makes use of the dual, liquid/gas properties of a supercritical fluid and makes use of the liquid properties of a supercritical fluid as a solvent for dissolving the sample and the gas properties of the supercritical fluid as a carrier gas in the process of jetting into vacuum.

By this invention, for the first time, a non-volatile, pyrolytic, or thermally unstable sample, regardless of it being of electrolytic molecules or non-electrolytic molecules, can be vaporized without heating to a high temperature and be taken into vacuum as a jet-cooled gas.

Because a supercritical fluid is a fluid of high pressure in the excess of 100 bars, a device for jetting it into a chamber of low pressure must be designed accordingly. To obtain an adequate jet cooling effect, the pressure of the vacuum chamber must be maintained at $10^{-4}$ Torr or less even during jetting. Though if costs are ignored, a method of jetting the gas continuously using a pinhole and performing high rate evacuation of the inflowing gas using a gigantic pump may be employed, an adequately low pressure of the vacuum chamber can be achieved even with a pump of low evacuation rate if the gas is jetted intermittently using a pulse valve, and this is of merit in terms of cost as well because the amount of gas consumed can be lessened.

Here, care must be taken in that the abovementioned "cooling" is not cooling in the normal sense, that is, it does not refer to a state of low temperature. To start with, temperature is a concept that is applicable to a thermal equilibrium, in other words, a state that is in accordance with the Boltzmann distribution, and because a gas that is jetted into vacuum is not in a thermal equilibrium, the concept of temperature in the normal sense does not apply. The abovementioned "cooling" has two meanings, the mechanisms of which differ as follows.

In a first meaning, "cooling" refers to a state in which translational velocities are matched. This corresponds to "cooling" because when a plurality of molecules are matched in translational velocity, the relative velocity becomes zero and thus the Boltzmann temperature becomes zero. Such a process is a phenomenon that occurs when a gas is jetted at once from a high pressure to a low pressure (preferably vacuum or a pressure close to vacuum), and the greater the pressure difference between the abovementioned high pressure and low pressure, the better the degree of matching of the translational velocities, and in order to attain this, the smaller the diameter of an orifice for jetting the gas, the more preferable.

In another meaning, "cooling" refers to cooling of intermolecular energies (vibration and rotational energies). Cooling of intermolecular states occurs when, in the process of passage through an orifice, sample molecules collide inelastic ally with carrier molecules and the intermolecular energies are converted to translational velocities of the carrier molecules. Thus, though a smaller orifice diameter is better in terms of creating a large pressure difference, if an orifice of diameter that is smaller than the mean free path of molecules is used, the internal states of the sample molecules are not cooled because intermolecular collisions do not occur adequately during passage through the orifice. Such a gas flow is called a leak jet. With a method of introducing a supercritical fluid into vacuum using an ultrafine capillary as in the conventional SCF-Mass method, a decompression gradient is formed toward the vicinity of the capillary exit, and because the aperture diameter is extremely small, the gas flow becomes a typical leak jet. The abovementioned collisions are important for the "cooling" process, and for collisions to occur adequately, the orifice must have a diameter that is at least greater than the mean free path of the sample molecules. Thus, for cooling of internal energies, the orifice diameter should be better to be larger.

The optimal conditions of these two "cooling" processes are in conflict with each other in terms of the orifice diameter of the jet nozzle, and in order to meet these optimal conditions at the same time, the pressure of a vacuum chamber into which jetting is performed must be adequately low by using a vacuum pump of high evacuation rate to make large the pressure difference of atmospheres before and after jetting of the sample molecules or molecular aggregates while making the abovementioned orifice diameter large to secure an adequate internal energy cooling effect.

Here, "internal energies" refer to the vibration and rotational energies of the respective gas molecules. Care is needed because internal energy as generally referred to in thermodynamics includes translational kinetic energies of these gas molecules as well.

From the above, "jet cooling" is a process of converting various energy levels to translational energy and thereby monochromatizing the internal energy levels (because the energy of light is determined by the wavelength, that is, by the "color", the matching of energy states of not just light but in general is referred to as "monochromatization").

Because whereas the degree of vacuum inside the jetting chamber is approximately $10^{-4}$ to $10^{-5}$ Torr, the pressure of the interior of the mass analyzer must be kept at approximately $10^{-7}$ Torr, the connection between the two components must be designed with this in consideration. Appropriate measures must also be taken to introduce the supersonic jet expansion, obtained from the jetting chamber, into the mass analyzer while maintaining the jet cooling effect. Thus, with this invention, a differential evacuation chamber is disposed between the jet generating device and the mass analyzer, a skimmer is disposed in a gas flow path between the jet generating device and the differential evacuation chamber, and a skimmer is also disposed in a gas flow path between the differential evacuation chamber and the mass analyzer.

Because a skimmer differs from a normal pinhole in that an aperture with a sharp, edge-like cross section is provided at a front end of the skimmer, the scattering of a supersonic molecular beam is prevented as much as possible in the process of passage through the aperture and thermal excitation of the gas in the jet cooled state does not occur readily.

When a gas passes through a pinhole, the gas is thermally excited by the scattering of gas molecules near the edge of pinhole, and though whether or not this thermal excitation occurs is not an issue in normal mass spectrometry, because in order to know the internal structures of sample molecules or molecular aggregates as is intended in the present invention, the sample molecules or molecular aggregates must be maintained at the non-thermally-excited lowest energy level, skimmers are used.

The aperture diameter of each skimmer is determined by the "thickness" of the molecular beam that is required, and in the present invention, because a laser that is focused by a lens (the focused diameter being several μm) is irradiated onto the molecular beam, in principle, it is sufficient that the molecular beam be of a "thickness" close to the focused diameter of the laser. However, because it is difficult to manufacture a skimmer of small aperture diameter and it is difficult to focus laser light onto a thin molecular beam, skimmers of an aperture of diameter of approximately 2 mm are used in this invention.

Because pressure adjustments of the jet cooling device, differential evacuation chamber, and mass analyzer are respectively performed by different molecular turbo pumps, even if there are large pressure differences among the components as mentioned above, the respective components can be maintained at predetermined pressures.

It is also known that when a minute amount of an additive (modifier) is added to a supercritical fluid, the supercritical extraction ability is improved, and thus a modifier may be added at an amount of 0 to 25 volume %.

Because the performance of a liquid delivery pump must be considered, the lower limit of the proportion of addition of a modifier cannot be designated but the upper limit of the amount added is 25 volume %. This is because, for example, when, with the total pressure being 100 atmospheres, 25 volume % of a modifier is added to supercritical carbon dioxide, the pressure of the carbon dioxide becomes 75 atmospheres, which is close to the critical pressure (an approximate guideline pressure above which a substance can be regarded as being a supercritical fluid) of carbon dioxide of 72.9 bars, and the properties as a fluid degrade. Also, when a large amount of modifier is added, clusters, in which large amounts of modifier molecules are attached to the sample molecules or molecular aggregates, form and obstruct mass spectrometry.

EFFECT OF THE INVENTION

This invention provides the following effects:

1. An isolated gas phase state of non-volatile or pyrolytic molecules or molecular aggregates can be attained at low temperature to enable supersonic molecular beam laser spectroscopy research of bimolecular and other pyrolytic samples and high molecular weight functional molecules, which has been impossible up until now.

2. Not only does the invention contribute to basic scientific research but the invention is also effective for establishing evaluation and measurement techniques for various functional molecules developed through recent nanotechnology research and for research on structures and electron structures of molecular aggregates.

3. This invention can be applied to the clarification of molecular recognition mechanisms in living organisms.

Especially in the case of neurotransmitters, an aggregate of a neurotransmitter and a receptor can be formed in a molecular beam by the supercritical fluid jet method and a molecular approach on the molecular recognition mechanism can be made using various laser spectroscopic techniques.

4. By making the leak jet of the conventional SCF-Mass method a supersonic jet, this invention enables the application of the resonance-enhanced multiphase laser ionization method.

BEST MODES FOR CARRYING OUT THE INVENTION

Embodiments of this invention shall now be described along with the drawings.

Figure 1:
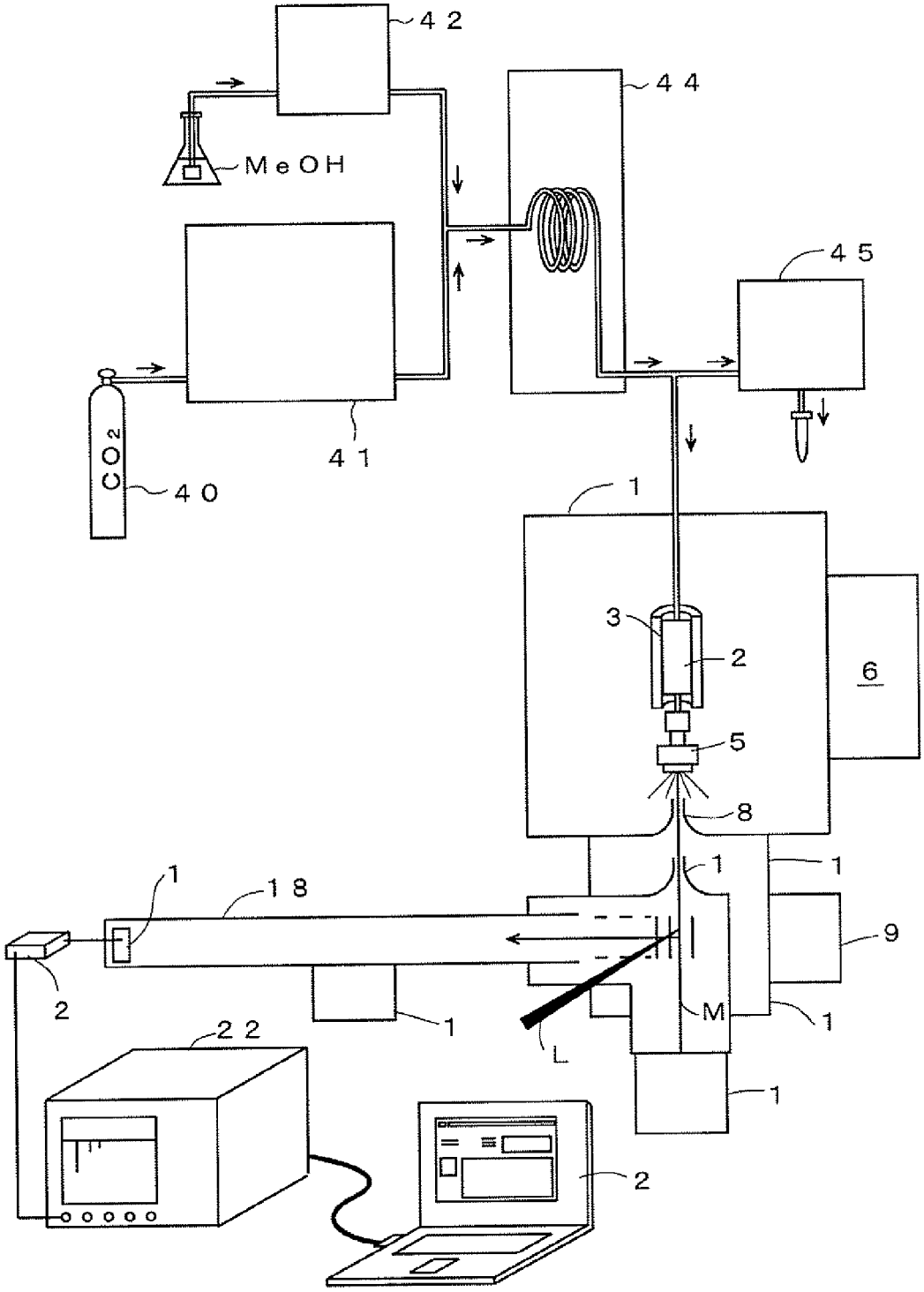
FIG. 1 is an overall view of an experimental device for mass spectrometry according to an embodiment of this invention.

FIG. 1 is an overall diagram of an experimental device for performing mass spectrometry according to this invention. The experimental method was carried out as follows.

A general carbon dioxide gas (carbon dioxide gas of 95 volume % concentration; made by Tomoe Shokai Co., Ltd.) inside a gas cylinder 40 was pressurized and liquefied by a liquefied carbon dioxide delivery pump 41 (SCF-Get; made by JASCO Corp.) and delivered in a constant flow rate mode (5 ml/min). As a modifier, methanol (99.8% purity; made by Wako Pure Chemical Industries, Ltd.) was delivered in a constant flow rate mode at a flow rate of 0.2 ml/min by an HPLC delivery pump 42 (PU-2080; made by JASCO Corp.) and mixed (at approximately 4 volume %) with the liquefied carbon dioxide gas.

The mixture thus obtained was heated to 50° C. in a preheating oven 44 (SCF-LRO; made by JASCO Corp.) and put in a supercritical state. The modifier-added supercritical carbon dioxide was introduced into an automatic regulator valve 45 (SCF-Bpg; made by JASCO Corp.) and maintained at 100 bars.

The modifier-added supercritical carbon dioxide of fixed pressure that was branched prior to automatic regulator valve 45 was introduced into a sample holder 2, set inside a vacuum chamber (supercritical fluid jet generating device) 1. Sample holder 2 was heated to 50° C. by a heater 3 and 1-naphthol (purified by vacuum sublimation of 1-naphthol of 98% purity, made by Tokyo Chemical Industry Co., Ltd.) was extracted. Jetting into supercritical fluid jet generating device (jetting chamber) 1 was performed at 20 Hz repetition by an electromagnetic pulse valve 5 (EL-7-3-200, made in the device workshop of Tel Aviv University) that was installed directly below sample holder 2.

1-naphthol, which was used as a verification experiment sample, has a melting point of 288° C. and a sample gas thereof of adequate concentration cannot be normally obtained unless heated to approximately 100° C. The 1-naphthol was thus dissolved in the supercritical carbon dioxide with approximately 4 volume % methanol added at 50° C. and 100 bars as described above, and this mixture was jetted into vacuum via pulse valve 5.

Supercritical fluid jet generating device 1 was evacuated using a turbo molecular pump 6 (TMH-1601P; made by Pfeiffer Vacuum Technology AG (Germany)) at an evacuation rate of 1600 liters/s. The degree of vacuum during jetting was $9\times10^{-5}$ Torr. The generated supersonic jet expansion was formed into a molecular beam M by a skimmer 8 (Model-2; made by Beam Dynamics Inc.) of 2 mm aperture diameter. Molecular beam M, which was thus obtained was passed through a differential evacuation chamber 10, having a turbo molecular pump 9 (STP-451; made by BOC Edwards Inc. (United Kingdom)) of an evacuation rate 480 liters/s, and thereafter introduced via a skimmer 12 of the same model as that mentioned above into a laser ionization chamber 13. Laser ionization chamber 13 was evacuated with a turbo molecular pump 14 (of the same model as turbo molecular pump 9) and the pressure of the laser ionization chamber 13 during jetting was $1\times10^{-6}$ Torr.

Figure 2:
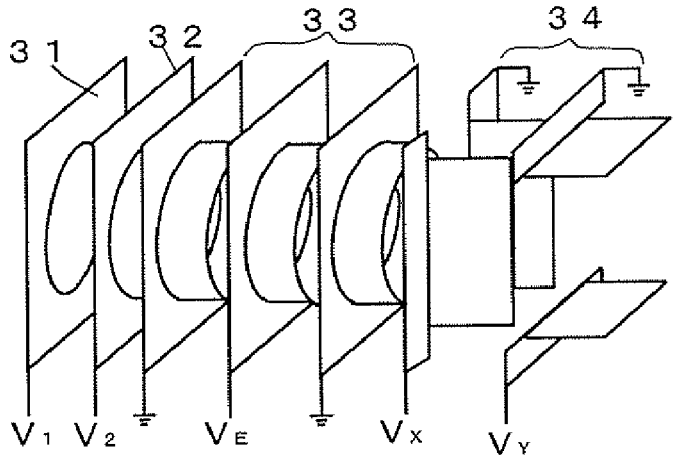
FIG. 2 is an arrangement diagram of an ion lens system of FIG. 1.

In laser ionization chamber 13, molecular beam M passes through exactly the middle between a repelled electrode 31 and an extractor electrode 32 of an ion lens system shown in FIG. 2. A tunable ultraviolet laser L was focused here to perform ionization. Positive ions that were generated were drawn out in a direction perpendicular to the molecular beam by means of three electrodes (repelled: 3.54 kV, extractor: 1.14 kV, first stage Einzel lens: 0V). The trajectory was corrected using Einzel lenses 33 (first and last stages: 0V, middle stage: 1.54 kV) and a deflecting electrode 34 and the ion beam was converged via a 1.8 m flight tube 18 (pressure-$5\times10^{-7}$ Torr), evacuated by a turbo molecular pump 17 (of the same model as turbo molecular pump 9), onto a Daly type ion detector 16 to detect the ions.

Figure 3:
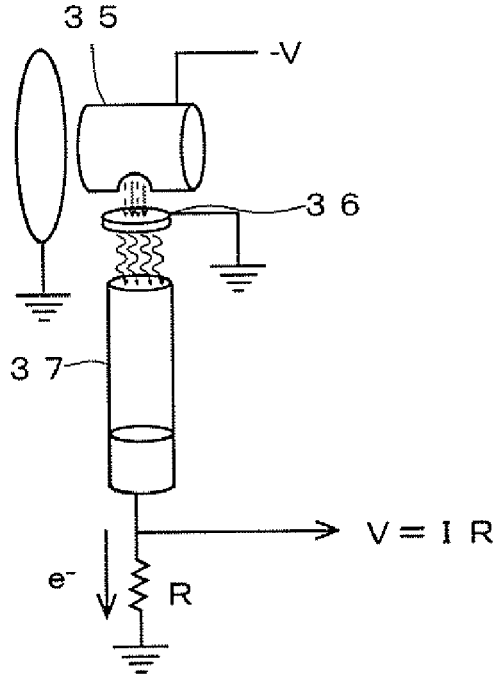
FIG. 3 is an arrangement diagram of an ion detector of FIG. 1.

A detailed arrangement of Daly type ion detector 16 is shown in FIG. 3, and this detector is arranged from an aluminum target 35, to which a negative high voltage (−10 kV) is applied, a scintillate 36 (NE102A; made by Ohyo Koken Kogyo K.K.), and a photomultiplier tube 37 (R1450; made by Hamamatsu Photonics Co., Ltd.). The positive ions are drawn to and collide against aluminum target 35. Secondary electrons are then emitted from the aluminum surface, and these are converted into light signals at scintillate 36 and detected by photomultiplier tube 37. A current output from photomultiplier tube 37 is converted to a voltage signal by a 1 kΩ resistor, amplified by 10 times by a preamplifier 21 (BX-31A; made by NF Corp.), and recorded by a digital oscilloscope 22 (DS-4374; made by Iwatsu Test Instruments Corp.). Data are then transferred from digital oscilloscope 22 to a personal computer 23 and mass spectrum and a REMPI (resonance-enhanced multiphase ionization) spectrum are recorded on personal computer 23.

The tunable ultraviolet laser was obtained by second harmonic conversion of light from a tunable dye laser (Cobra-Stretch; made by Sirah (Germany)), excited by a YAG laser (INDI-40; made by Spectra-Physics Inc.), in a non-linear optical crystal (KDP; made by INRAD Inc. (USA)) inside an automatic phase matching angle tracking device (AUTO TRACKER III; made by INRAD Inc. (USA)) The laser device emits a pulse laser of a pulse width of several nanoseconds at 20 Hz repetition in synchronization with the electromagnetic pulse valve. The laser intensity was decreased using a neutral density filter to several μJ/pulse and focused inside laser ionization chamber 13 by a synthetic quartz lens with a focal length of 220 mm.

Figure 4:
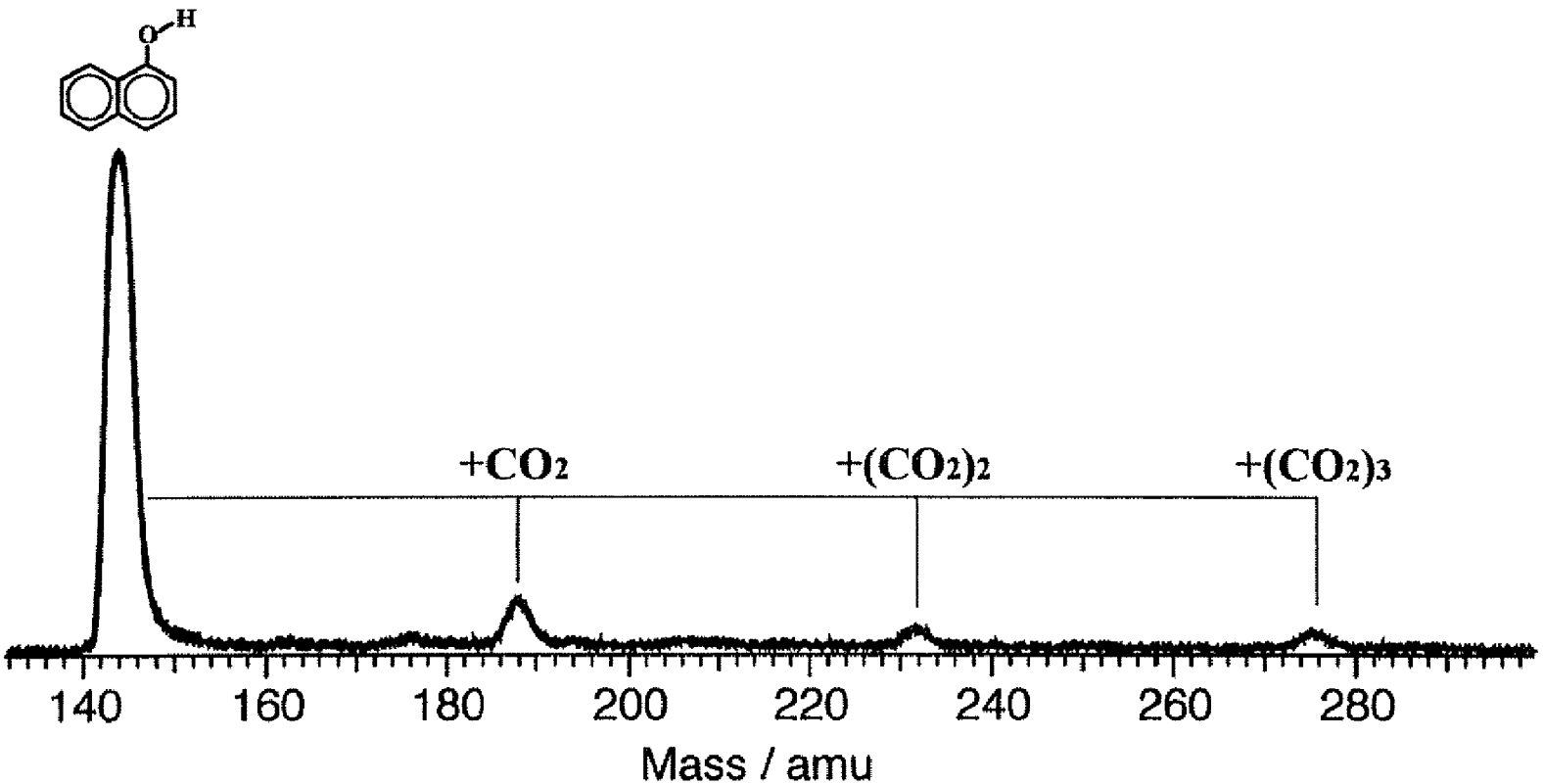
FIG. 4 is a mass spectrum of 1-naphthol that has been obtained by the embodiment of this invention.

A mass spectrum that was obtained is shown in FIG. 4. Besides 1-naphthol, clusters, with each of which a small number of carbon dioxide molecules are attached to 1-naphthol, were observed, though in small amounts. This result indicates that supercritical carbon dioxide does not attach in large amounts to 1-naphthol to form droplets, that is, supercritical carbon dioxide does not obstruct measurement of the mass spectrum.

Figure 5:
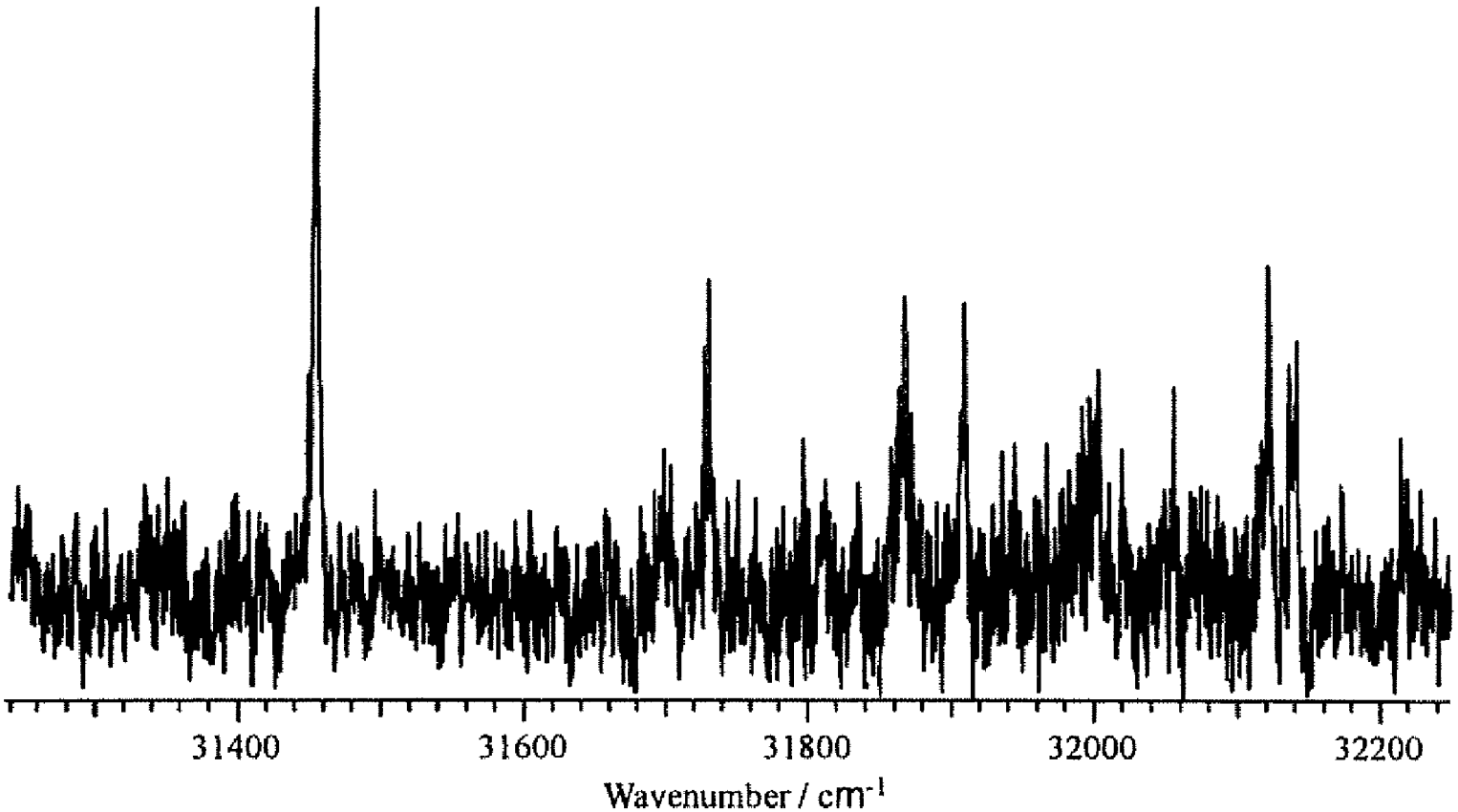
FIG. 5 is a REMPI spectrum of 1-naphthol that has been obtained by the embodiment of this invention.

The result of a REMPI spectrum, obtained by scanning the wavelength of the ionizing laser with monitoring the peak or 1-naphthol, is shown in FIG. 5.

In the scanned wavelength range of the ionization laser, 1-naphthol ionizes upon absorbing two photons simultaneously. In this process, when the first photon resonates with an internal quantum level of 1-naphthol, the probability of absorption of the second photon is increased drastically by the resonance effect and a peak of the ion amount is observed (resonance-enhanced multi-photon ionization spectrum). It is known that peaks of a resonance-enhanced multi-photon ionization spectrum of adequately jet-cooled molecules exhibit sharp shapes, and the result here indicates that the supercritical fluid jet method according to the present embodiment provides an adequate jet-cooling effect. The sharp peaks of the present embodiment shown in FIG. 5 correspond to the zero vibration level of the first electronically excited level (the peak at the lowest energy side (left side of FIG. 5)) and to vibration excitation levels (the plurality of peaks at the right side of FIG. 5) of 1-naphthol.

From a comparison of the present invention with the invention of Japanese Published Unexamined Patent Application No. 2003-329556 (Patent Document 1), the following can be said.

With the invention described in Patent Document 1 (see FIG. 6), there is the following problem.

Figure 6:
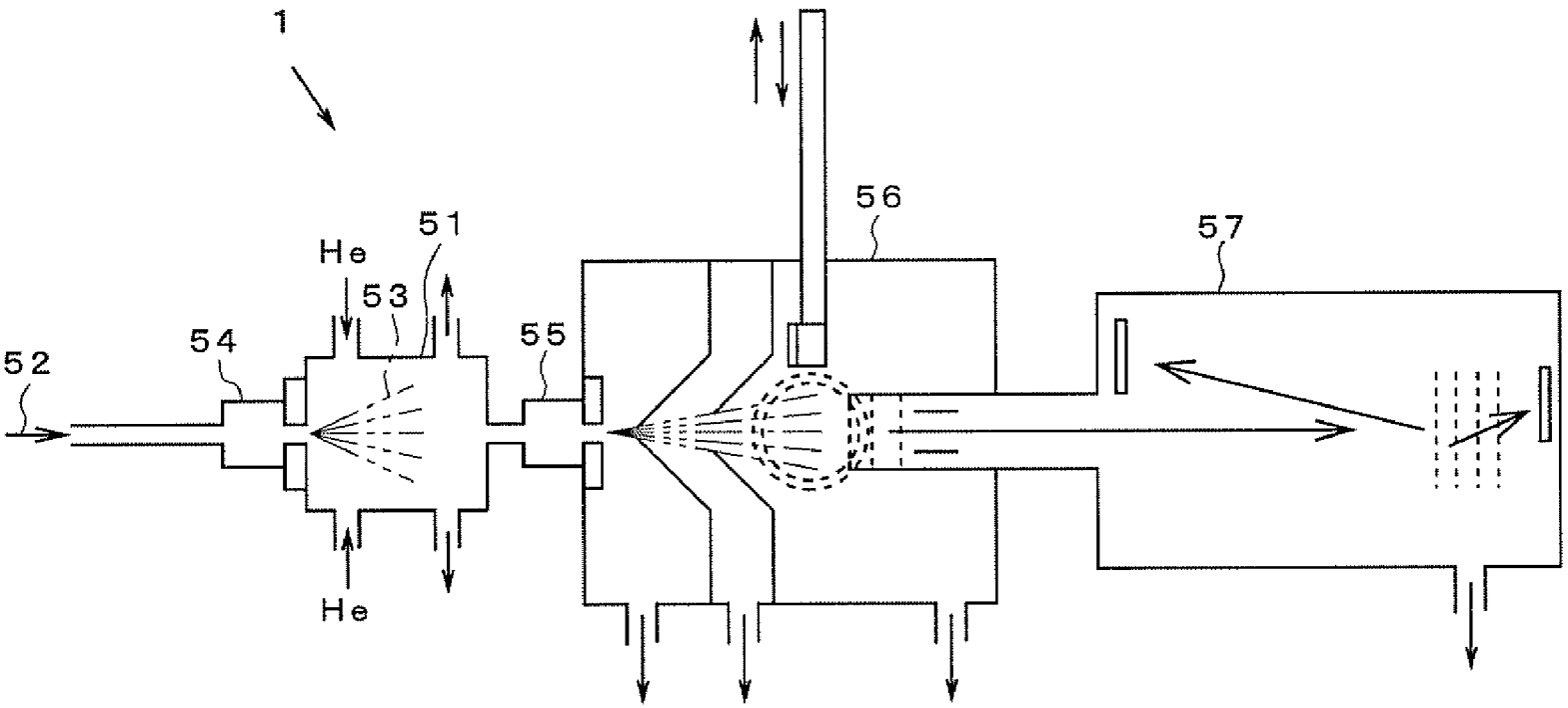
FIG. 6 Prior Art
FIG. 6 is an arrangement diagram of a device for generating a beam of pyrolytic or non-volatile molecules by a conventional art.

That is, because a normal solvent is strong in intermolecular force (and is thus a liquid at room temperature), solvent molecules, in which non-volatile molecules (sample that does not vaporize even upon heating) are dissolved, cannot be removed readily just by jetting into a jetting chamber 51 and colliding with nitrogen or argon gas. As shown in FIG. 6, with the invention described in Patent Document 1, though a micro particulate sample 53, delivered from a sample solution 52 via first delivery means 54 into jetting chamber 51, through which helium gas of approximately 1 bar flows, is put in a form of concentrated micro particles in open solution or ultra-microparticles in solution, even if ideally the solvent molecules, in which the sample is dissolved, can be removed and the sample micro particles can be put in a state in which each molecule is isolated and separated from other molecules (gaseous state), when these sample molecules that are mutually isolated from each other are introduced as a supersonic jet expansion into vacuum device 56 from inside jetting chamber 51 of approximately 1 bar by use of second delivery means SS (jet cooling occurs in this process), clusters (in a droplet state before collision with the abovementioned nitrogen or argon gas), in each of which large amounts of solvent molecules are attached to a sample molecule (solute molecule), are formed by the three-body collision of the sample molecule (solute molecule), solvent molecule, and solvent-removing molecule (the abovementioned nitrogen or argon gas) in the process of jetting. Such large clusters not only makes mass spectrum analysis at a mass spectrometry device 57 complicated but also makes spectroscopic measurement by scanning of the ionization laser wavelength difficult.

Thus, with the embodiment of Patent Document 1, only data indicating a relationship between sample molecule flight time and signal intensity are obtained as results from mass spectrometry device 57.

On the other hand, with the embodiment of the present invention, as indicated in the obtained mass spectrum shown in FIG. 4, just clusters, in each of which a small number of carbon dioxide molecules are attached to 1-naphthol, are observed slightly in addition to the sample molecules (1-naphthol), and sharp peak shapes, indicating adequately jet-cooled molecules, are exhibited in the resonance-enhanced multi-photon ionization spectrum shown in FIG. 5.

The difference between the jet of Patent Document 1 and the supercritical fluid jet of the present invention is as follows.

That is, a major point of difference is that whereas with the method of Patent Document 1, vaporization of the non-volatile sample and jet cooling are performed separately (the former is performed by first delivery means 54 while the latter is performed by second delivery means 55), with the supercritical fluid jet method of the present invention, the abovementioned two processes can be performed simultaneously by performing jetting of the supercritical fluid extraction of the non-volatile sample once.

When vaporization of the non-volatile sample and jet cooling are performed in two stages as in the method of Patent Document 1, the sample may cool and become a solid before jet cooling. If in order to prevent this, the flow rate at second delivery means 55 is increased (to perform introduction into vacuum device 56 before cooling and precipitation occur) and a continuous introduction method (method of introducing into vacuum not by a pulse valve but continuously through a pinhole) is employed, a low pressure cannot be maintained unless a pump of exceptionally high evacuation rate is used, and as a result, an adequate jet cooling effect cannot be obtained. The supercritical fluid jet method, in which vaporization and jet cooling are performed simultaneously, is effective for resolving this problem.

INDUSTRIAL APPLICABILITY

This invention enables supersonic molecular beam laser spectroscopy research of bimolecular and other pyrolytic samples and functional molecules of high molecular weight, which has been impossible up until now, and not only contributes to basic scientific research on molecular recognition mechanisms in living organisms, etc., but can also be applied to evaluation and measuring techniques for various functional molecules developed through recent nanotechnology research and applied as a method of non-destructively vaporizing non-volatile or pyrolytic samples in manufacturing a structural multilayer film by molecular beam epitaxial of the non-volatile or pyrolytic molecules, flattening a solid surface by sputtering, etc.

DESCRIPTION OF THE SYMBOLS

1: vacuum device (supercritical fluid jet generating device)
2: sample holder
3: heater
5: pulse valve
6, 9, 14, 17: turbo molecular pump
8, 12: skimmer
10: differential evacuation chamber
13: laser ionization chamber
16: Daly type ion detector
18: flight tube
21: preamplifier
22: digital oscilloscope
23: personal computer
31: repelled electrode
32: extractor electrode
33: Einzel lens
34: deflecting electrode
35: aluminum target
36: scintillate

37: photomultiplier tube
40: gas cylinder

What is claimed is:

1. A method of generating a supersonic jet expansion, wherein a mixture of a supercritical fluid and a non-volatile sample or a mixture of a supercritical fluid and a pyrolytic sample is jetted into a high vacuum chamber of $10^{-7}$ Torr or more to generate a supersonic jet expansion of sample molecules in the lowest energy level without intermolecular collisions or molecular aggregates containing the sample molecules.

2. A mass spectrometry method using a supercritical fluid jet method, wherein a mixture of a supercritical fluid and a non-volatile sample or a mixture of a supercritical fluid and a pyrolytic sample is put under high vacuum of $10^{-7}$ Torr or more to generate a supersonic jet expansion of sample molecules in the lowest energy level without intermolecular collisions or molecular aggregates containing the sample molecules to obtain a molecular beam, ions of the sample molecules in the lowest energy level without intermolecular collisions or molecular aggregates containing the sample molecules are obtained from the molecular beam by performing a laser ionization method, and mass spectrometry is performed on the ions.

3. The mass spectrometry method using the supercritical fluid jet method according to claim 2, wherein in a supercritical jet generating device, a pulse valve is used to perform supersonic jetting of a mixture of a supercritical fluid and a non-volatile sample or a mixture of a supercritical fluid and a pyrolytic sample to obtain the supersonic jet expansion, the supersonic jet expansion is introduced via a skimmer into a differential evacuation chamber under a high vacuum of $10^{-5}$ Torr or more, the supersonic jet expansion is furthermore passed, via a skimmer, through high vacuum of $10^{-7}$ Torr or more to obtain the molecular beam, the sample molecules obtained from the abovementioned molecular beam or the molecular aggregates containing the sample molecules are ionized from the molecular beam by a resonance-enhanced multiphoton ionization method using a tunable laser, and mass spectrometry is performed on the ions.

4. The mass spectrometry method using the supercritical fluid jet method according to claim 3, wherein 25 volume % or less of at least one modifier selected from the group of modifiers consisting of water, methanol, ethanol, dioxane, acetonitrile, tetrahydrofuran, diisopropyl ether, and diethyl ether is added to the mixture of the supercritical fluid and the sample.

5. A mass spectrometry device using a supercritical fluid jet method comprising: a supercritical fluid jet generating device that performs supersonic jetting of a mixture of a supercritical fluid and a non-volatile sample or a mixture of a supercritical fluid and a pyrolytic sample; a laser ionization chamber that obtains and ionizes a molecular beam from a supersonic jet expansion jetted from the jet generating device; and a mass analyzer, performing mass spectrometry of ions obtained from the laser ionization chamber and set under a pressure of $10^{-7}$ Torr or more.

6. The mass spectrometry device using the supercritical fluid jet method according to claim 5, wherein a pulse valve that generates the supersonic jet expansion is disposed in the supercritical fluid jet generating device, a differential evacuation chamber is disposed between the jet generating device and the laser ionization chamber, and skimmers are disposed at respective portions through which the supersonic jet expansion passes between the jet generating device and the differential evacuation chamber and between the differential evacuation chamber and the laser ionization chamber.

* * * * *